United States Patent [19]

Stryker

[11] 4,024,879

[45] May 24, 1977

[54] STICK-A-BROW

[76] Inventor: Sylvia A. Stryker, 1993 Beech St., Wantagh, N.Y. 11793

[22] Filed: Oct. 16, 1975

[21] Appl. No.: 623,044

[52] U.S. Cl. ..... 132/88.5
[51] Int. Cl.[2] ..... A45D 40/30
[58] Field of Search ..... 132/88.5, 53, 73, 88.7

[56] References Cited

UNITED STATES PATENTS

| | | | |
|---|---|---|---|
| 2,917,058 | 12/1959 | Ferrar | 132/88.5 |
| 3,165,107 | 1/1965 | Martin et al. | 132/53 |
| 3,266,500 | 8/1966 | Weld | 132/53 |
| 3,598,685 | 8/1971 | Lee et al. | 132/73 |
| 3,718,145 | 2/1973 | Chateau | 132/88.5 |

*Primary Examiner*—G.E. McNeill
*Attorney, Agent, or Firm*—Eugene V. Mandel

[57] ABSTRACT

An eyebrow beauty kit of hair bearing flexible adhesive backed material.

10 Claims, 3 Drawing Figures

STICK-A-BROW

BACKGROUND OF THE INVENTION

This invention relates to artificial hair covered objects for application on the human physiognomy. It further relates to such objects for use as eyebrows.

Artificial decoration and alteration of human appearance has long been known and practised. Initial modifications were those of inserts, however painful, or of color. Color decoration has been long and extensively practised.

Artificial objects, such as eyebrows, of flexible material, hair, coloring, and adhesive have been known.

The object of this invention is an accessory for modifying human appearance, whether for vanity, health or disguise. A further object is to provide an accessory susceptible to ready modification by the user.

Yet another object is a low cost manufacturing method for such accessories.

An additional object is a product easy to use because it is part of an easy to dispense package.

The essence of this invention is a kit of artificial hair covered objects for application to the human physiognomy. A card permitting the creation of several items of various sizes and shapes permits interesting adventures in self decoration. Prepunched shapes are also provided. Coloring is uniform or varied, as desired.

DESCRIPTION OF DRAWINGS

Further objects and advantages of this invention will appear more clearly from the following description of a non-limiting illustrative embodiments and the accompanying drawings in which like numerals designate like parts thruout the several views.

DECRIPTION OF TYPICAL EMBODIMENTS

Figure 1:
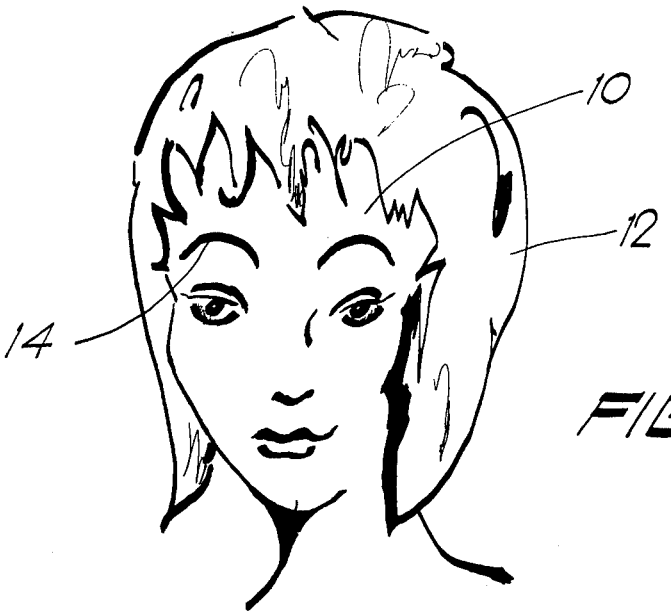
FIG. 1 shows the application of artificial eyebrows to a human face.
Figure 2:
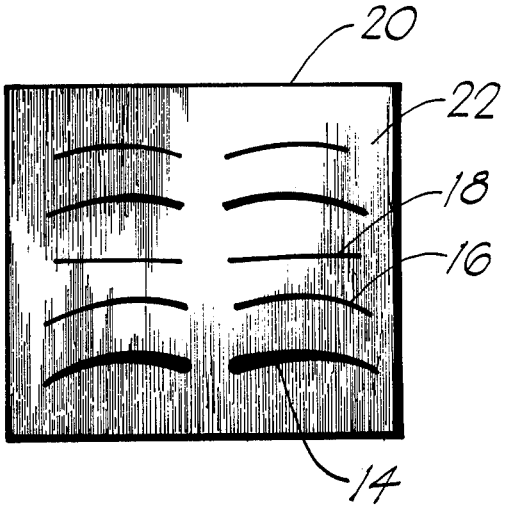
FIG. 2 is a front view of the card.
Figure 3:
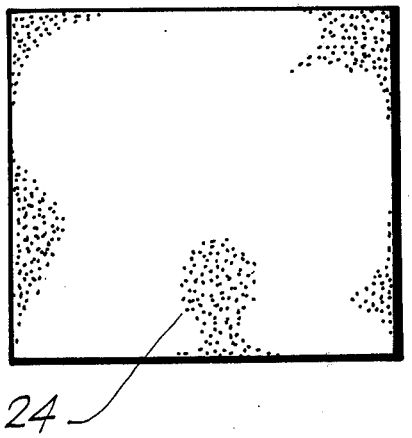
FIG. 3 is a rear view of the card.

In the drawings a card 20 embodying features of the invention is illustrated.

Artificial eyebrow 14 may be applied to the human face 10 to improve appearance or to repair damage.

Eyebrow 14 color may be changed to match hair 12 or wig or clothing.

General appearance may be modified by use of thick 14 or thin 16, arched or flat 18, long or short hair, or various colors. The eyebrow may be used long 14 or short 18.

A single card 20 may have hair 22 in one shade, or in several, blond, brunette, black, red, etc. The face of the card is generally flesh coloured: i.e.: light, dark, etc.

The card 20 may have preimpressed parts outlines for easy ejection. Common preimpressed techniques include prescore, perforate, prepunch, etc. Or the user may employ a cutting tool such as a scissors. A design may be hand drawn on the back of the card with a very soft marker. The card 20 is made of a soft semiflexible material, comfortable to the wearer. Card 20 is generally provided with an adhesive backing which may be pressure sensitive.

Hair used may be natural or animal or artificial synthetic.

Of course, other decorating schemes besides those mentioned may be employed.

The invention includes all novelty residing in the description and drawings. It is obvious to those skilled in the art that various minor changes can be made without departing from the concept of this invention and all such as fall within the reasonable scope of the appended claims are inclamed.

What is claimed is:

1. A beauty kit comprising a card of semiflexible material, the back of which is covered by an adhesive, and the front of which has hair attached, the card being preimpressed in specific shapes such as eyebrows, the preimpression permitting ready separation and expulsion of a specific piece from the card.

2. A beauty kit as in claim 1 comprising artificial eyebrows.

3. A beauty kit as in claim 1 further comprising colors applied to the front of the card.

4. A beauty kit as in claim 3 in which more than one color is used.

5. A beauty kit as in claim 1 in which the hair is colored.

6. A beauty kit as in claim 5 in which more than one color is used.

7. A beauty kit as in claim 1 in which only specific areas are covered by hair.

8. A beauty kit is in claim 1 in which the hair is natural.

9. A beauty kit as in claim 1 in which the hair is artificial.

10. A beauty kit as in claim 1 in which the adhesive is pressure sensitive.

* * * * *